United States Patent [19]

Dwyer

[11] 3,992,988

[45] Nov. 23, 1976

[54] DEVICE FOR IMPRINTING INDICIA ON A FLEXIBLE ARTICLE

[76] Inventor: James F. Dwyer, 47 Kenyon St., Providence, R.I. 02903

[22] Filed: June 23, 1975

[21] Appl. No.: 589,784

Related U.S. Application Data

[63] Continuation-in-part of Ser. No. 538,421, Jan. 3, 1975.

[52] U.S. Cl. ..... 101/9; 24/255 BS; 40/11 R; 101/27; 101/407 R

[51] Int. Cl.[2] ..... B44B 5/00; B41F 1/28

[58] Field of Search ..... 101/DIG. 12, 415.1, 101/409, 407 BP, 407 R, 9, 10, 21, 27, 31, 33, 34, DIG. 4, 126, 126.1, 127.1, 114, 269, 415; 24/67.9, DIG. 8, 255 BS, 255 P, 255 RS, 81 PC; 40/11, 64

[56] References Cited

UNITED STATES PATENTS

| | | | |
|---|---|---|---|
| 1,370,169 | 3/1921 | Turner | 101/407 BP |
| 1,686,940 | 10/1928 | Tatousek | 101/407 BP |
| 1,773,673 | 8/1930 | Haluorsen et al. | 101/9 |
| 1,799,754 | 4/1931 | Lawrence | 8/25 |
| 1,982,158 | 11/1934 | Gould et al. | 101/407 BP |
| 1,987,370 | 1/1935 | Pleger | 101/407 BP X |
| 2,025,691 | 12/1935 | Mintz | 101/407 BP |
| 2,066,269 | 12/1936 | Horll | 101/126 |
| 2,076,023 | 4/1937 | Halsted | 101/407 BP |
| 2,123,564 | 7/1938 | Dalton | 101/407 BP |
| 2,176,371 | 10/1939 | Wahl | 101/269 |
| 2,604,387 | 7/1952 | Mintz | 101/DIG. 4 |
| 2,776,509 | 1/1957 | Kienel | 41/1 |
| 2,800,078 | 7/1957 | Lightbourn | 101/415 |
| 2,865,289 | 12/1958 | Fowlie et al. | 101/409 |
| 2,881,700 | 4/1959 | Podgor | 101/126 |
| 2,900,751 | 8/1959 | Mintz | 41/7 |
| 3,336,864 | 8/1967 | Guthrie | 101/127.1 X |
| 3,841,217 | 10/1974 | Hodges | 101/DIG. 12 |
| 3,845,521 | 11/1974 | McNichol | 24/255 P |

*Primary Examiner*—Edgar S. Burr
*Assistant Examiner*—Paul J. Hirsch
*Attorney, Agent, or Firm*—Salter & Michaelson

[57] ABSTRACT

A device for imprinting indicia on a flexible article such as a duffel bag, tote bag, T-shirt or the like through the application of heat, the device including an indicia holder that is positively located for positioning indicia strips in proper oriented position in overlying relation on the article. A heating block is movable into positive engagement with the indicia strips as they overlie the article, wherein indicia is transferred from the strips by heat of the heating block onto the article for the permanent imprinting thereon.

7 Claims, 13 Drawing Figures

DEVICE FOR IMPRINTING INDICIA ON A FLEXIBLE ARTICLE

BACKGROUND OF THE INVENTION

This is a continuation-in-part of application Ser. No. 538,421, filed Jan. 3, 1975 and entitled DEVICE FOR IMPRINTING INDICIA ON A FLEXIBLE ARTICLE.

The present invention relates to a portable device for use in a retail establishment for transferring indicia from a carrier onto a flexible article by the application of heat thereto.

The application of indicia such as identifying lettering or numbers and designs to flexible articles such as duffel bags, tote bags, articles of clothing and the like has usually been accomplished heretofore upon purchase of the article in a retail establishment by either ink stenciling or monograming by embroidery or by ironing individual letters onto the article. Although ink stenciling of indicia onto flexible articles accomplished the purpose intended, this technique was somewhat laborious and required special stenciling equipment and ink that necessitated appropriate skills on the part of the individual who applied the indicia to the flexible article. Some commercial processes for imprinting indicia or designs on flexible articles also accomplished the purpose intended, but necessarily had to be performed at a location where appropriate equipment was available for use. This kind of equipment was obviously complicated and expensive and could not be employed in a retail establishment.

Prior to the instant invention some efforts have been made to employ transfer printing techniques that utilize heat for transferring indicia to flexible articles. This technique had certain advantages in that the indicia as transferred was relatively permanent as applied, but the indicia had to be individually transferred usually with a hand iron and was not only laborious but produced inconsistent and unsatisfactory results. Other devices known heretofore have also utilized the heat transfer principle for transferring indicia onto flexible articles, but these devices were relatively complicated and expensive, which economically prohibited the wide spread use thereof.

SUMMARY OF THE INVENTION

The imprinting device as embodied in the present invention provides for imprinting indicia on a flexible article such as a tote bag, duffel bag, T-shirt, and the like and includes a base on which a pad for receiving the article thereon is mounted, the pad defining an imprinting station. Stop means are located adjacent to the pad and imprinting station for positively locating the article in oriented imprinting position at the imprinting station. With the article located in oriented position at the imprinting station, an indicia holder is placed in position as determined by the stop means, which properly locates indicia strips carried by the holder in aligned and oriented position in overlying relation on the article. With the indicia strips properly located in engagement with the article, a heating member mounted on the base is moved into positive engagement with the indicia strips. The indicia is formed of a special ink that is heat responsive for transfer onto the article, and as transferred the indicia will remain on the article substantially for the life thereof.

Accordingly, it is an object of the present invention to provide a portable imprinting device for evenly transferring indicia in aligned and oriented relation onto a flexible article by the application of heat thereto.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENTS OF THE INVENTION

Figure 1:
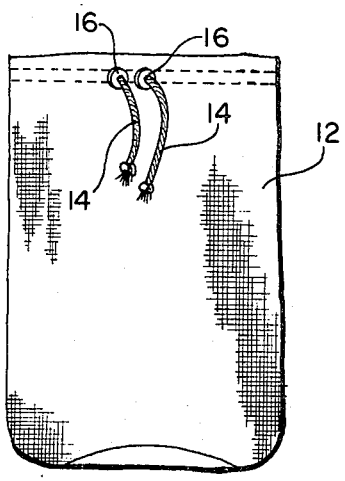
FIG. 1 is an elevational view of a conventional duffel bag onto which indicia is transferred through the use of the device embodied in the subject invention.
Figure 2:
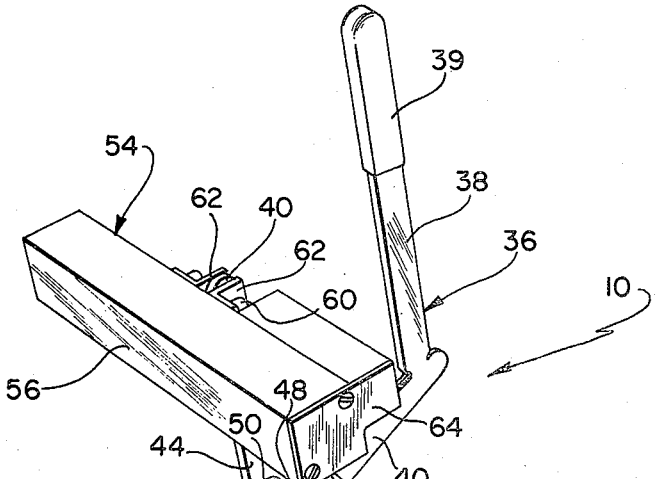
FIG. 2 is a perspective view of the portable indicia imprinting device as embodied in the subject invention and showing the location of a duffel bag thereon just prior to the imprinting operation.

Referring now to the drawings and particularly to FIG. 2, the imprinting device embodied in the present invention is illustrated and is generally indicated at 10. As shown, the imprinting device 10 is utilized for imprinting indicia such as lettering, numerals, designs and the like on flexible articles, an example of which is a duffel bag indicated at 12 in FIG. 1. The duffel bag 12 can be formed of any conventional cloth material and normally includes a draw string having ends 14 that extend outwardly of grommeted openings 16 to provide a closure for the bag.

Figure 5:
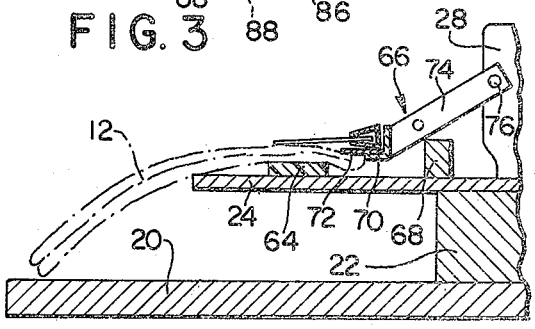
FIG. 5 is a view taken along line 5—5 in FIG. 4 and showing the location of the stop member for the duffel bag.

Referring again to FIG. 2, the imprinting device 10 includes a base generally indicated at 18 that is defined by a base board 20 to which a block 22 (FIG. 5) is secured at an end thereof. Also formed as part of the base 18 is a base plate 24 that is preferably formed of a metal material and that is secured to the block 22 and base board 20 by a bracket assembly 26 mounted on the upper surface of the base plate 24. As illustrated in FIG. 2, the bracket assembly 26 includes spaced apart walls 28 that extend in a vertical direction and to which horizontal flanges 30 are joined at right angles relative thereto. A bottom plate 32 bridges the space between the flanges 30 and cooperates with bolts 34 to fix the bracket assembly 26 to the base plate 24 and base board 20.

Mounted for pivotal movement on the bracket assembly 26 is a handle generally indicated at 36 that includes a bar 38 having a hand grip 39 formed on the outermost end thereof. Joined to the bar 38 in angular relation thereto is an elongated lever 40 that is defined at the inner end thereof by spaced portions 41, the spaced portions 41 being pivotally connected to the walls 28 of the bracket assembly 26 by a pin 42. As shown, the outermost ends of the spaced portions 41 are disposed in face-to-face engaging relation to define the elongated lever 40 as it is connected to the bar 38. Also mounted for pivotal movement between the spaced walls 28 of the bracket assembly 26 is a heating block support bar 44 that projects outwardly from between the walls 28 and is pivotally connected thereto by a pivot pin 46. An over-center connector 48 interconnects the support bar 44 to the lever 40 by means of the pivot pins 50 and 52, respectively.

Figure 6:
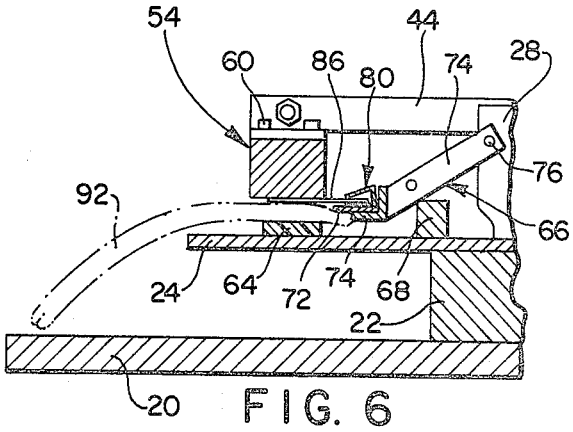
FIG. 6 is a view similar to FIG. 5 and showing the position of the heating member during the imprinting operation.

Mounted on the outermost end of the heating block support bar 44 is heating block generally indicated at 54 and that is formed with a heating surface 56. The heating block 54 is hollow for receiving a heating element therein to which current is supplied through an electrical lead 58. The heating block 54 is mounted on the outermost end of the support bar 44 by a bolt 60 that extends through the bar 44 and through brackets 62, the brackets 62 being fixed to the face of the heating block 54 that is opposite to the heating surface 56. An end plate 64 is also fixed to the heating block 54 and is removable therefrom to provide access to the interior of the member 54. As will be described, the heating block 54 is movable from the upper or inoperative position thereof as illustrated in FIG. 2 to a bottom or operative position illustrated in FIG. 6 upon pivotal movement of the handle 36 with respect to the bracket 26. Since the heating block 54 is interconnected to the handle 36, through the over-center connector 48 it will be moved to a positive locked position during the heating operation.

Mounted on the base plate 24 and spaced from the bracket assembly 26 is an elongated foam pad 64 that is substantially rectangular in cross sectional configuration. The pad 64 is located on the base plate 24 such that when the heating block 54 is moved to the lower position thereof, the heating surface 56 is disposed in overlying relation with respect to the upper face of the pad 64. As shown, the configuration of the upper face of the pad 64 is substantially the same as that of the heating surface 56 and thus accommodates substantially the full length of the surface 56 in the lower or operative position of the heating block. The pad 64 also defines the imprinting station and receives the article on which indicia is to be imprinted, as further illustrated in FIG. 2.

Since placement of a flexible article such as a duffel bag 12 on the pad 64 that defines the imprinting station must be accomplished in a precise manner to positively locate and orient the article and the indicia to be imprinted thereon, stop means are provided that are defined by a first stop member generally indicated at 66 and a second stop member 68 spaced from the stop member 66. The second stop member 68 is fixed directly to the base plate 24 and is disposed intermediate the pad 64 and the bracket assembly 26. As will be described, the second stop member 68 is for use primarily as a stop for special kinds of flexible articles such as a tote bag, and the use of the stop member 68 will be described hereinafter.

Figure 4:
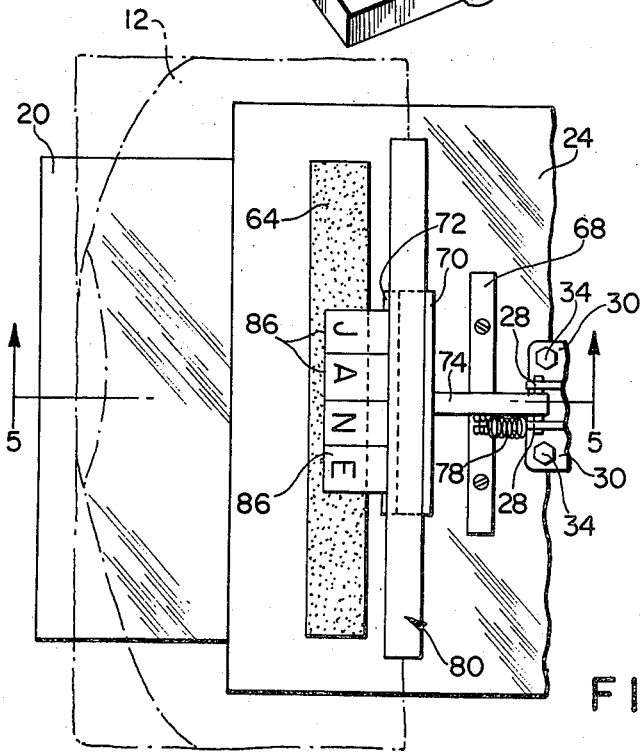
FIG. 4 is a top plan view of a portion of the imprinting device as illustrated in FIG. 2.

The first stop member 66 includes an angle bar 70 to the upper surface of the horizontal portion of which is fixed a strip 72 that defines a seat for receiving an indicia holder or letter bar as will be described. Joined to the vertical portion of the angle bar 70 is a bar 74 that is pivotally secured between the walls 28 of the bracket assembly 26 by a pivot pin 76. A spring 78 is interconnected to the 74 and to the bracket assembly and urges the first stop member 66 to either the lower position thereof as illustrated in FIGS. 2 and 4, or to an upper inoperative position. Movement of the first stop member 66 upwardly beyond the connection of the spring to the bracket assembly urges the spring to an over-center location, wherein the spring retains the first stop member at the inoperative upper position.

Figure 3:
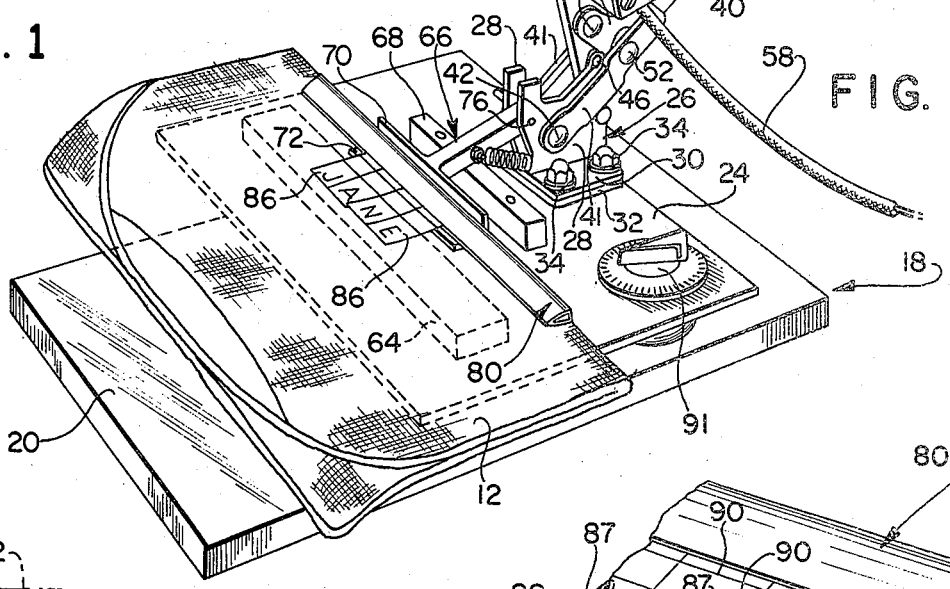
FIG. 3 is a perspective view of a portion of an indicia holder showing the manner in which flexible indicia strips on which the indicia are located are retained in oriented and aligned position by the holder for use in the imprinting operation.
Figure 3:
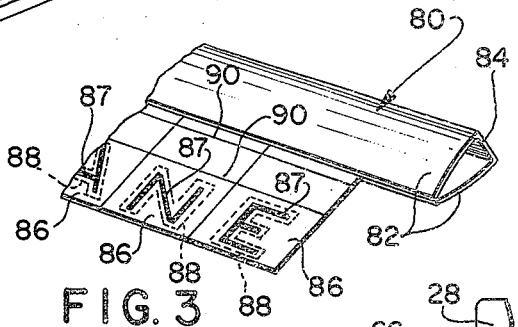
Figure 10:
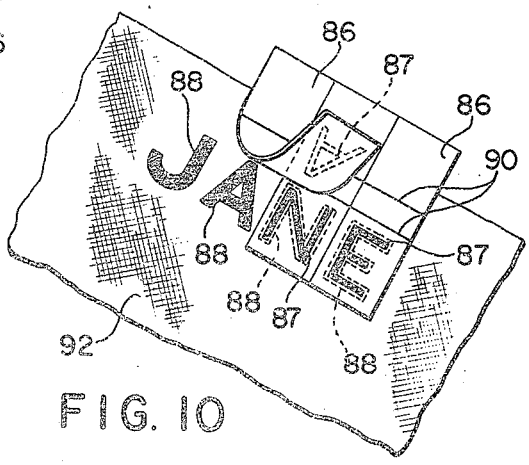
FIG. 10 is a fragmentary elevational view of an enlarged portion of the flexible article as imprinted showing the manner in which indicia is transferred from the indicia strips onto the flexible article.

In order to locate the indicia that is to be transferred onto a flexible article such as the duffel bag 12, an indicia holder or letter bar generally indicated at 80 is provided; and as illustrated in FIG. 3, the indicia holder 80 is defined by an elongated plastic member having opposed jaws 82 that are joined to a base 84. The jaws 82 are formed such that they engage at the outermost ends thereof; and since the holder is formed of a plastic material, the jaws 82 are separable to receive indicia strips 86 therebetween. The indicia strips 86 are formed of a special parchment paper that is especially treated on the upper surface thereof to receive a letter or number 87 thereon that provides for identification of the indicia to be transferred. The underside of the strips 86 are treated to receive a transfer ink that defines the indicia 88 and that is heat responsive wherein upon the application of heat thereto, the ink will be transferred onto a surface with which it is contact. As further shown in FIGS. 3 and 10, spaced lines 90 are imprinted on the upper surface of the strips 80 and provide for aligning of the strips in the holder 80 so that the indicia that form a name or the like will be evenly transferred onto the surface of the flexible article.

In use of the device, the handle 36 is pivoted to the position illustrated in FIG. 2 to elevate the heating block 54 to the upper position as shown in FIG. 2. A flexible article such as the duffel bag 12 is placed at the imprinting station on the pad 64 in the position as shown. For convenience, the duffel bag 12 is folded double and the folded edge is directed under the holder strip 72 of the stop member 66 for contact with the outer edge of the horizontal portion of the stop member 70, this edge defining a stop for locating the duffel bag 12 in the proper oriented position at the imprinting station.

The indicia holder or letter bar 80 is then placed on the holder strip 72, the indicia strips 86 overlying the upper surface of the duffel bag 12 and the indicia 88 to be transferred being generally in alignment with the pad 64. With the indicia strips 86 properly oriented with respect to the sides of the duffel bag 12, the handle 36 is pivoted downwardly to force the heating surface 56 of the heating block 54 into engagement with the indicia strips 86 and bag 12. The handle 38 is moved such that the over-center connector positively locks the heating block in the lower position. The heating surface 56 of the heating block directly contacts the indicia strips 86; and with current applied to the heating element within the heating block 54, the heating block is permitted to remain in contact with the indicia strips for a time interval such as ten seconds that will be sufficient to cause the transfer of the indicia onto the side of the bag 12 exposed thereto. A timer 91 is also provided and is located on the plate 24 and may be set for the required time interval to audibly indicate the termination of the heating period. When the timer sounds, the operator lifts the heating block 54 to the upper position thereof, and with the indicia having been transferred to the exposed side of the duffel bag 12, the bag is removed from the imprinting station.

Figure 7:
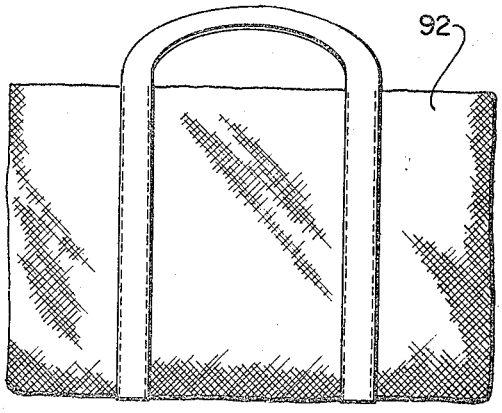
FIG. 7 is an elevational view of a tote bag that is to be imprinted by the imprinting device of the subject invention.
Figure 8:
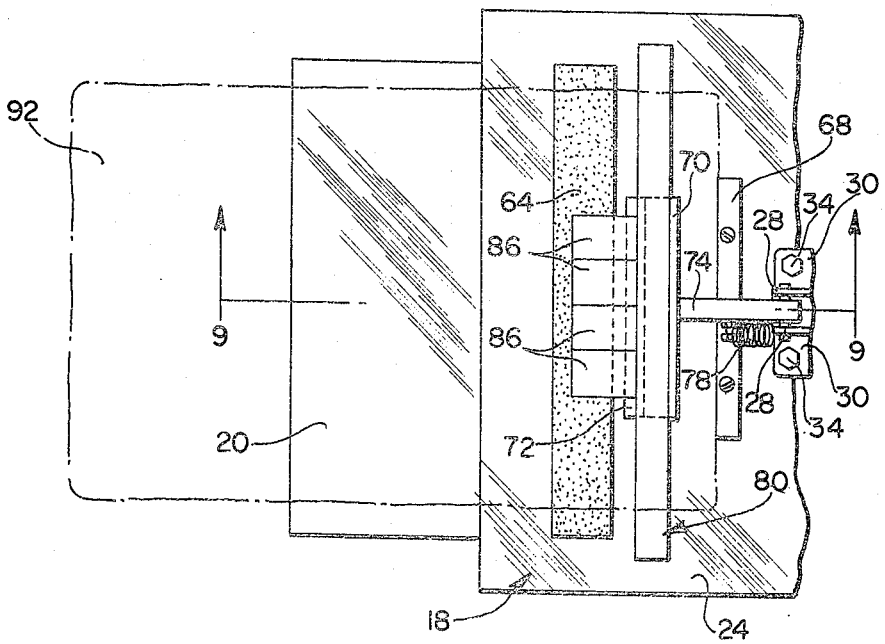
FIG. 8 is an elevational view showing a portion of the imprinting device as used to imprint indicia on the tote bag illustrated in FIG. 7.
Figure 9:
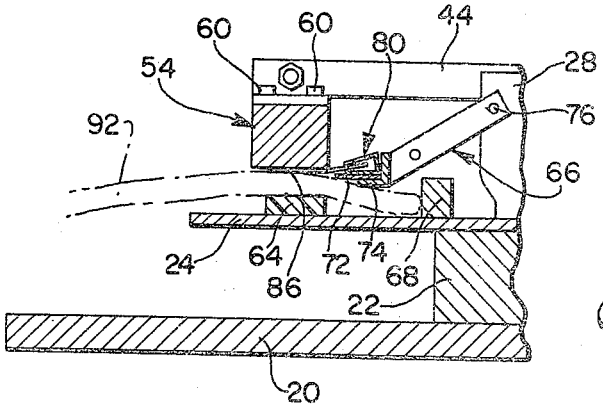
FIG. 9 is a view similar to FIG. 6 and showing the location of the tote bag in the imprinting operation and the stop member for use therewith.

Referring now to FIGS. 7 through 9, the use of the second stop member 68 is illustrated, and as shown this stop member is normally employed when a flexible article such as a tote bag indicated at 92 in FIG. 7 is to have indicia transferred onto a wall thereof. As shown in FIG. 9, the edge of the tote bag 92 is placed in engagement with the second stop member 68. The first stop member 66 which is initially moved upwardly to permit placement of the tote bag at the imprinting station is now returned to the lower position thereof in overlying relation with respect to the tote bag and in this position acts to fix the tote bag in position. The indicia holder 80 with the appropriate indicia strips located therein is placed on the strip 72 as previously described, to locate the indicia strips 86 in overlying relation on the exposed wall of the tote bag. The heating block 54 is then moved to the lower locked position thereof in contact with the indicia strip; and after the required interval of time the heating block is lifted following transfer of the indicia onto the wall of the tote bag in contact therewith. As further shown in FIG. 10, removal of the indicia strips 86 after the heating thereof transfers the indicia 88 thereon to the wall of the bag.

Although not shown, it is contemplated that various other forms of indicia holders or letter bars will be utilized to locate the indicia strips in proper oriented position. In this connection indicia strips may be secured to clips or pins that are releasably mounted on a letter bar. Other forms of indicia holding elements for letter bars contemplated for use are magnet clips, pressure clips, pressure sensitive adhesives, slide bars, overlay bars and other similar holding devices; and all of these indicia holding elements are considered to be within the spirit and scope of the holding elements as illustrated and described herein.

Figure 11:
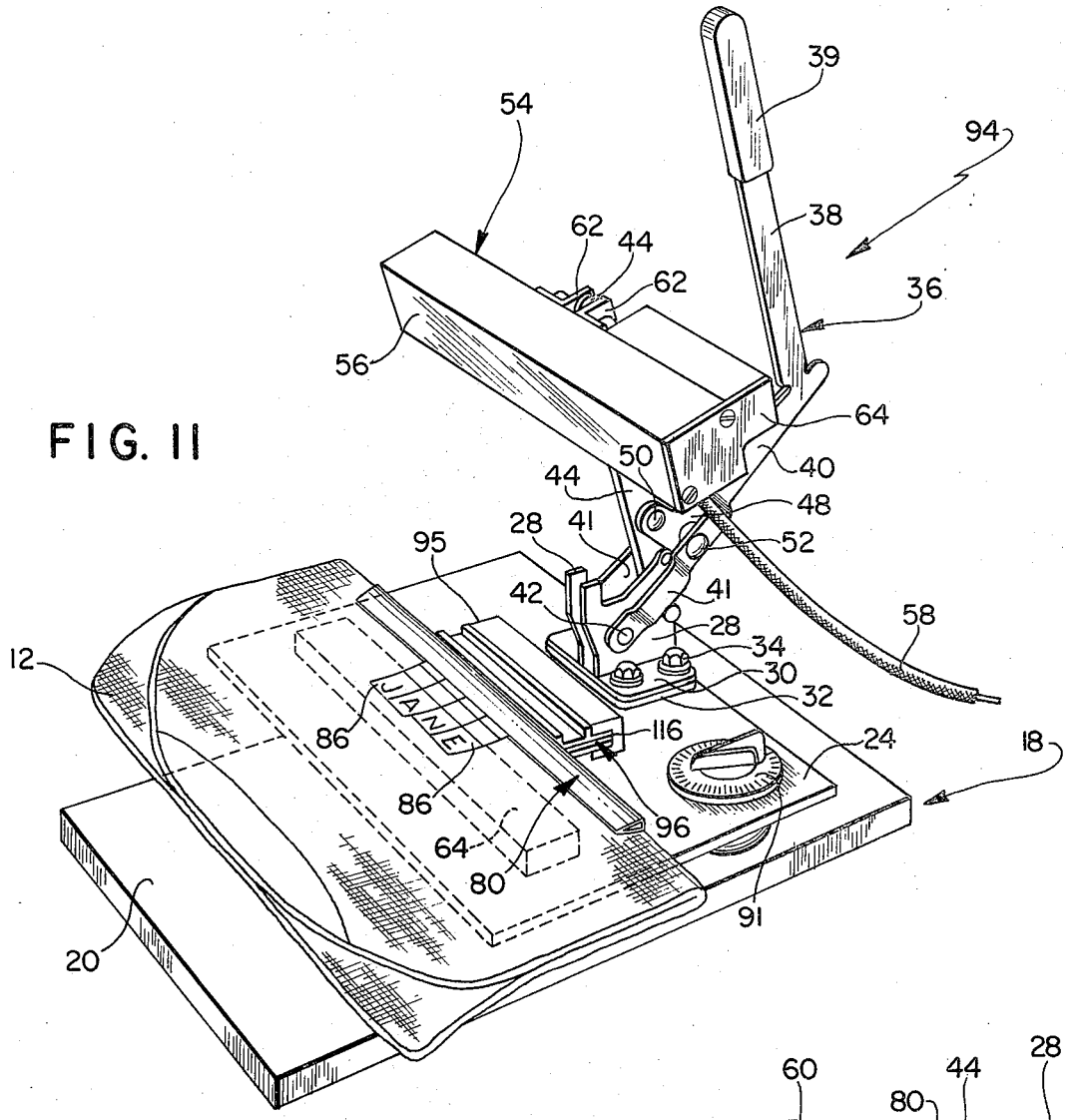
FIG. 11 is a perspective view of a modified form of the invention.
Figure 12:
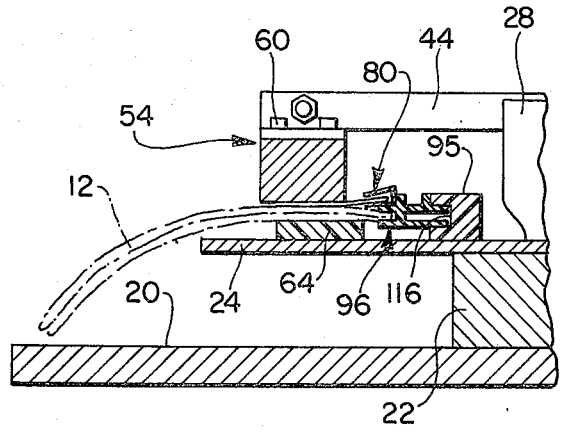
FIG. 12 is a sectional view of the modified imprinting device showing the position of the heating member during an imprinting operation on a duffel bag.
Figure 13:
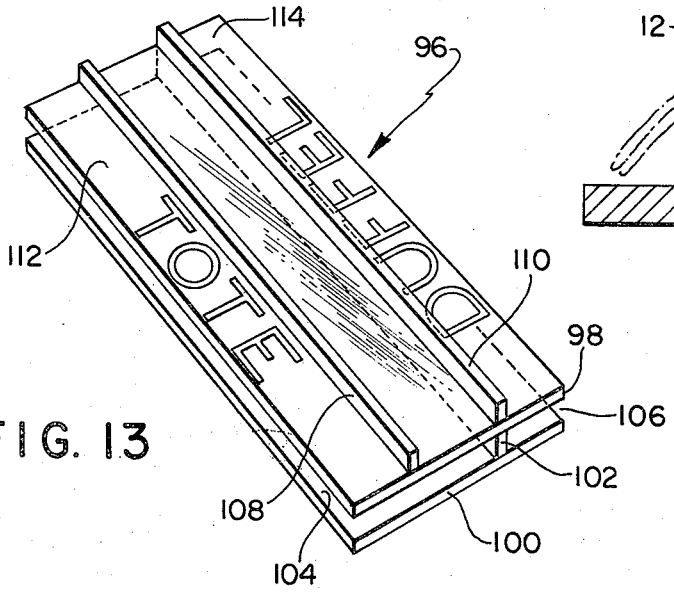
FIG. 13 is a perspective view of an article locating member that is employed in the modified imprinting device.

Referring now to FIGS. 11, 12 and 13, a modified form of the imprinting device is illustrated and is generally indicated at 94. The imprinting device 94 is substantially similar to the imprinting device 10 and includes the base 18 defined by the base board 20 to which the block 22 is secured, a base plate 24 being mounted on the block 22 by a bracket assembly 26. Mounted for pivotal movement on the bracket assembly 26 is the handle 36 and the support bar 44 on which is mounted the heating block 56. Also mounted on the base plate and spaced from the bracket assembly 26 is the elongated foam pad 64 that defines the imprinting station for receiving the article on which indicia is to be imprinted.

The imprinting device 94 differs basically from the imprinting device 10 in that the stop member 66 is eliminated, although a stop member 95 is mounted on the base plate 24 as will be described hereinafter. Replacing the stop member 66 in the modified device 94 is a combined holder and stop member generally indicated at 96. As shown more clearly in FIG. 13, the combined holder and stop member 96 is defined by an upper wall 98 from which a lower wall 100 is spaced. An internal longitudinally extending rib 102 divides the space between the upper wall 98 and lower wall into a wide slot 104 and a narrow slot 106. Joined to the upper surface of the upper wall 98 and extending the length thereof are spaced ribs 108 and 110 that are approximately equally spaced from the adjacent longitudinally extending edges of the upper wall 98 to define shelves 112 and 114 respectively. Each shelf 112 and 114 is formed so as to accommodate the indicia holder 80 thereon during the imprinting operation; and as further shown in FIGS. 11 and 12, the stop member 95 is formed with a longitudinally extending slot 116 that is dimensioned for receiving therein in supporting relation either edge of the member 96 that includes shelf 112 or shelf 114. As will be described below, when a tote bag is to be imprinted, the wide slot 104 faces outwardly of the stop member 95 for accommodating an edge of a tote bag, the shelf 112 having the word "TOTE" printed thereon to instruct the user of the device to insert the edge of a tote bag to be imprinted into the slot 116. Similarly, the narrow slot 106 accommodates the edge of a duffel bag therein, the shelf 114 being marked with the word "DUFFEL" thereon.

In use of the form of the invention illustrated in FIGS. 11, 12 and 13, it is first assumed that a duffel bag 12 is to be imprinted with appropriate indicia thereon. The duffel bag 12 is folded and then inserted into the narrow slot 106 of the member 96. With the heating block 54 located in the retracted position, the member 96 is mounted on the stop member 95 by inserting the end of the memer 96 opposite to that in which the duffel bag is inserted into the slot 116, the rib 110 abutting against the outer marginal edge of the stop member 95. In the mounted position of the member 96 with the duffel bag inserted therein, the remaining portion of the duffel bag extends outwardly of the base plate 24, and overlies the pad 64 which defines the imprinting station. The indicia holder or letter bar 80 with the appropriate indicia carried thereby is placed on the exposed shelf 114 as illustrated in FIG. 11, the indicia strips overlying the upper surface of the duffel bag 12, and the indicia to be transferred being generally in alignment with the pad 64. The handle 36 is thereafter pivoted downwardly to force the heating surface of the heating block 54 into engagement with the indicia strips and bag 12, and as previously described the timer 91 may be utilized to audibly indicate the termination of the heating period to indicate to the operator that the indicia has been transferred to the bag and that the heating block 54 should be retracted. It is understood that the operation for imprinting indicia on a tote bag is similar to that just described, except that the member 96 is reversed in position on the stop member 95, wherein the wide slot 104 is exposed for receiving the tote bag therein, and the letter bar 80 carrying the appropriate indicia is thereafter placed on the shelf 112.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for imprinting indicia on a flexible article, comprising a base, a resilient pad mounted on said base for receiving an article thereon and defining an imprinting station, a stop mounted on said base adjacent to said pad for locating said article in oriented imprinting position at said imprinting station, said indicia being deposited on individually, preformed indicia strips and being heat responsive for transfer onto an article in contact therewith, a combined stop and holder member removably mounted on said stop, said holder member being formed with an upper wall, a lower wall spaced from said upper wall in parallel relation thereto and a longitudinally extending element joined to said upper and lower walls and fixed therebetween for locating said walls in spaced apart relation, said longitudinally extending element separating the walls to form a space therebetween which defines a longitudinally extending slot, the depth of said slot being of predetermined dimension for receiving an article in frictional relation therein, wherein the article is properly oriented for the imprinting operation when the holder member is mounted on said stop, and an indicia strip retaining member for receiving selected indicia strips therein and being mountable in overlying relation on said holder when the article is located in a slot of said holder, wherein the indicia strips are positioned over said article at said imprinting station, a heating member mounted on said base, and means for moving said heating member into positive engagement with said printed indicia that overlies said article at said imprinting station, wherein said indicia is transferred by heat from sid heating member onto said article.

2. A device as claimed in claim 1, a rib formed on said upper wall of said stop and holder member and being spaced from the outer edge of said upper wall to define a shelf, said retaining member being received on said shelf for locating said printed indicia in oriented overlying relation with respect to said article during the imprinting operation

3. A device as claimed in claim 2, a second slot formed in the space in said stop and holder member as defined by said walls and longitudinally extending element, said second slot extending in parallel opposed relation to said first slot and the depth of said second slot differing from that of the first named slot, wherein said second named slot receives a flexible article of a shaped and configuration that is different from that of the article received in said first named slot.

4. A device as claimed in claim 3, said stop and holder member being reversibly insertable into engagement with said stop to expose one of said slots with an article thereon, wherein the article secured in said stop and holder member is located at said imprinting station in oriented relation.

5. A device as claimed in claim 1, said stop having a longitudinal slot formed therein for receiving said stop and holder member in supporting relation for positioning said article at the imprinting station.

6. A device as claimed in claim 5, the upper wall of said stop and holder member having a longitudinally extending rib formed thereon that defines a longitudinally extending shelf said retaining member being receivable on said shelf and being oriented thereby to locate said indicia in proper overlying relation with respect to said article.

7. A device as claimed in claim 6, said stop and holder member having a second slot and shelf formed therein in opposed relation to the first named slot and shelf and being reversible in position on said stop means, said second slot receiving another article therein for locating the article in oriented relation at the imprinting station, said retaining member being locatable on the associated shelf of said stop and holder member for positioning the indicia in proper oriented overlying position on said second named article.

* * * * *